US006099054A

United States Patent [19]

Glass et al.

[11] Patent Number: 6,099,054

[45] Date of Patent: Aug. 8, 2000

[54] LATCH DOG ASSEMBLY

[75] Inventors: Gerald E. Glass, Springfield; John M. McClure, Florissant, both of Mo.

[73] Assignee: Custom Metalcraft, Inc., Springfield, Mo.

[21] Appl. No.: 09/181,472

[22] Filed: Oct. 28, 1998

[51] Int. Cl.[7] ..... E05B 15/02

[52] U.S. Cl. ..... 292/340; 292/241; 292/DIG. 57

[58] Field of Search ..... 292/340, 341.11, 292/341.12, 341.13, DIG. 56, DIG. 57, DIG. 64, 256.71, 240, 241, 58, 257, DIG. 15, DIG. 19; 384/2, 22, 41, 25, 40; 403/188, 199, 192, 204, 245, 263, 282, 315, 316, 318, 319; 220/325, 327, 328

[56] References Cited

U.S. PATENT DOCUMENTS

| | | | |
|---|---|---|---|
| 518,453 | 4/1894 | Hollar . | |
| 974,650 | 11/1910 | Ford . | |
| 2,194,138 | 3/1940 | Crawford . | |
| 2,499,165 | 2/1950 | Roethel . | |
| 2,970,718 | 2/1961 | Jennings, Jr. . | |
| 3,130,855 | 4/1964 | Gunn, Jr. . | |
| 3,510,162 | 5/1970 | Smith . | |
| 3,567,263 | 3/1971 | McKinney . | |
| 4,357,249 | 11/1982 | Mellor | 252/12 |
| 4,896,908 | 1/1990 | Kleefeldt . | |
| 5,230,542 | 7/1993 | Wiese . | |

*Primary Examiner*—B. Dayoan
*Assistant Examiner*—Gary Estremsky
*Attorney, Agent, or Firm*—Bergert & Bergert

[57] ABSTRACT

A latch dog assembly for latching and unlatching a storage bin door includes a latch dog member having a base portion, an end wall portion, and a cylindrical wear block member which extends outwardly from an opening on the inner wall of the end wall member so as to allow a latching cam to properly secure the bin door while avoiding undesired metal to metal contact. In one embodiment of the invention, a projection extends outwardly from the latch dog member base portion upper surface so as to assist in retaining the wear block member within the opening in the inner face of the end wall portion.

12 Claims, 3 Drawing Sheets

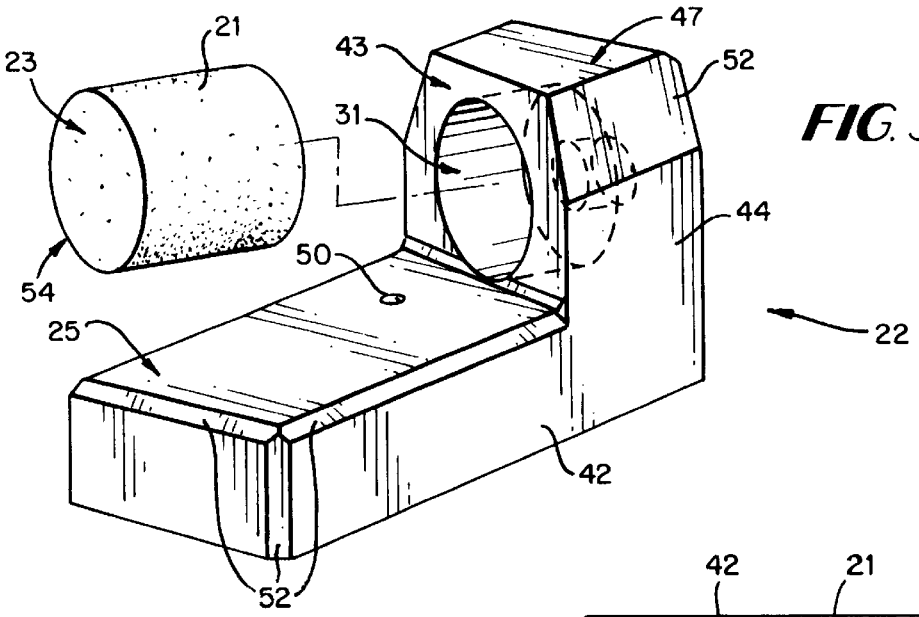
FIG. 3
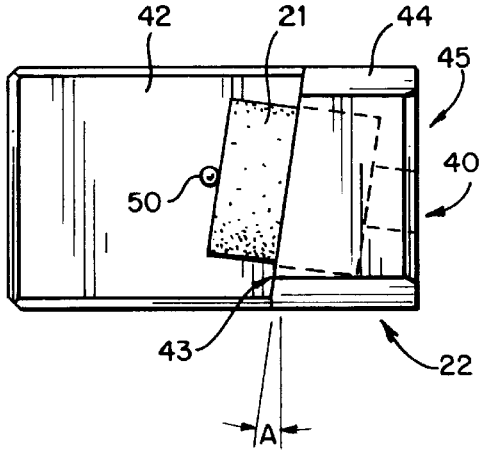
FIG. 4
FIG. 6
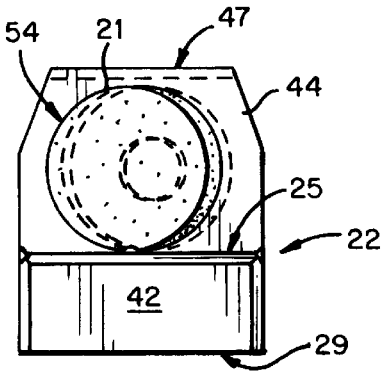
FIG. 5
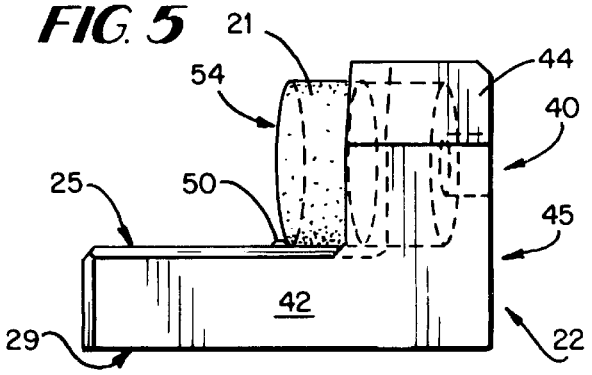

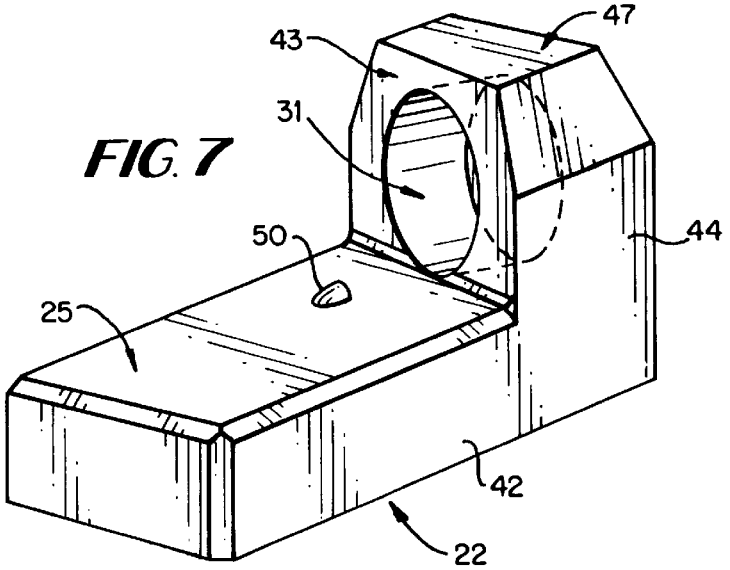
FIG. 7
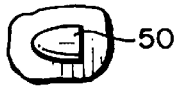
FIG. 11A
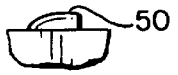
FIG. 11B
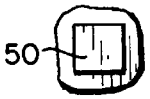
FIG. 12A
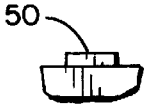
FIG. 12B
FIG. 8
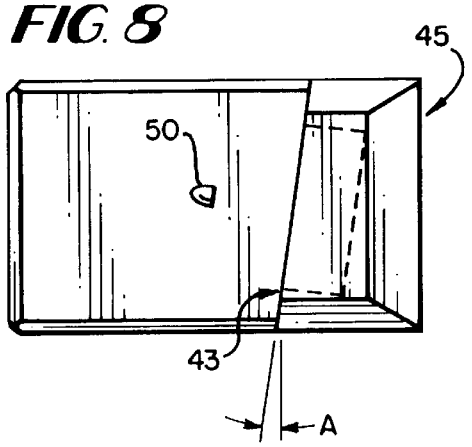
FIG. 10
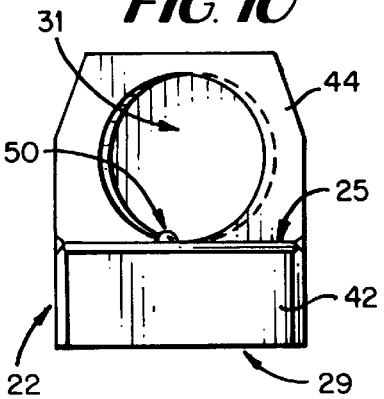
FIG. 9
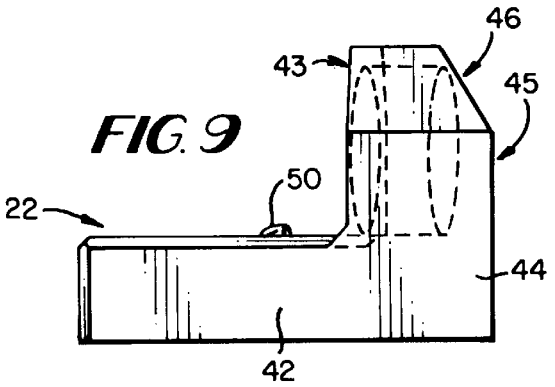

LATCH DOG ASSEMBLY

BACKGROUND AND SUMMARY OF THE INVENTION

The present invention relates to latches for containers and more particularly to a durable latch dog assembly for containers which meets FDA, USDA, and other governmental requirements.

Previous door latch assemblies are described in the following U.S. Pat. Nos.: 974,650 to Ford; 2,499,165 to Roethel; 2,970,718 to Jennings; 3,130,855 to Gunn; 3,567,263 to McKinney; 4,896,908 to Kleefeldt; and 5,230,542 to Wiese.

By the present invention there is provided an improved door latch assembly which is particularly well suited for use with containers having a hinged discharge door and cam means for latching and unlatching the door. The latch dog assembly of the present invention includes a latch dog housing which supports a wear block of UHMW (ultra-high molecular weight) polyethylene plastic or similar material. The assembly is constructed so that pressure of the door cam as well as the presence of a dimple on the housing retains the wear block in proper position while allowing the wear block to be easily removed for thorough cleaning. Operation of the latch dog assembly also avoids undesired metal to metal contact between the door cam and the latch dog assembly.

Thus it is one object of the present invention to provide a latch dog assembly with an easily removable wear block so as to allow thorough cleaning and simple replacement without any special tools.

It is another object of the present invention to provide a latch dog assembly which will avoid metal to metal contact between the door cam and the latch dog assembly.

Further objects, features, and advantages of this invention will become more readily apparent from the following description taken in conjunction with the accompanying drawings.

BRIEF DESCRIPTION OF THE DRAWINGS

FIG. 3 is an exploded perspective view of the latch dog housing with wear block insert;

FIG. 4 is a top view of the latch dog housing with wear block insert;

FIG. 5 is a side view of the latch dog housing with wear block insert;

FIG. 6 is is left end view of the latch dog housing with wear block insert;

FIG. 7 is a rotated perspective view of another embodiment of the latch dog housing;

FIG. 8 is a top view of the latch dog housing of FIG. 7;

FIG. 9 is side view of the latch dog housing of FIG. 7;

FIG. 10 is a left end view of the latch dog housing of FIG. 7;

FIG. 11*a* is a fragmented top plan view showing the embodiment of the projection shown in FIGS. 7 through 10;

FIG. 11*b* is a fragmented front view of the embodiment of the projection shown in FIG. 11*a;*

FIG. 12*a* is a fragmented top plan view showing a further embodiment of a similar for use in the present invention; and FIG. 12*b* is a fragmented front view of the embodiment of the similar projection shown in FIG. 12*a*.

DESCRIPTION OF THE PREFERRED EMBODIMENTS

Figure 1:
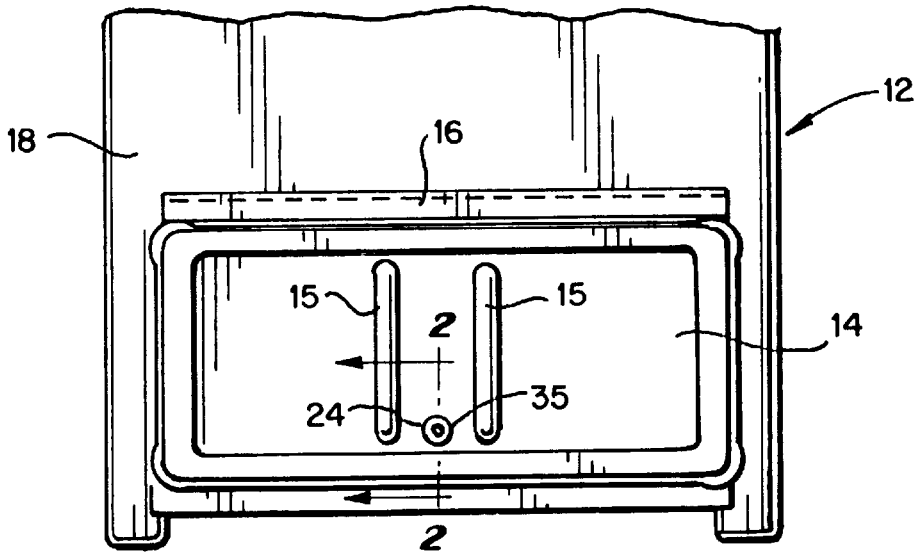
FIG. 1 is a front view of a storage bin provided with the improved latch dog assembly of this invention.
Figure 2:
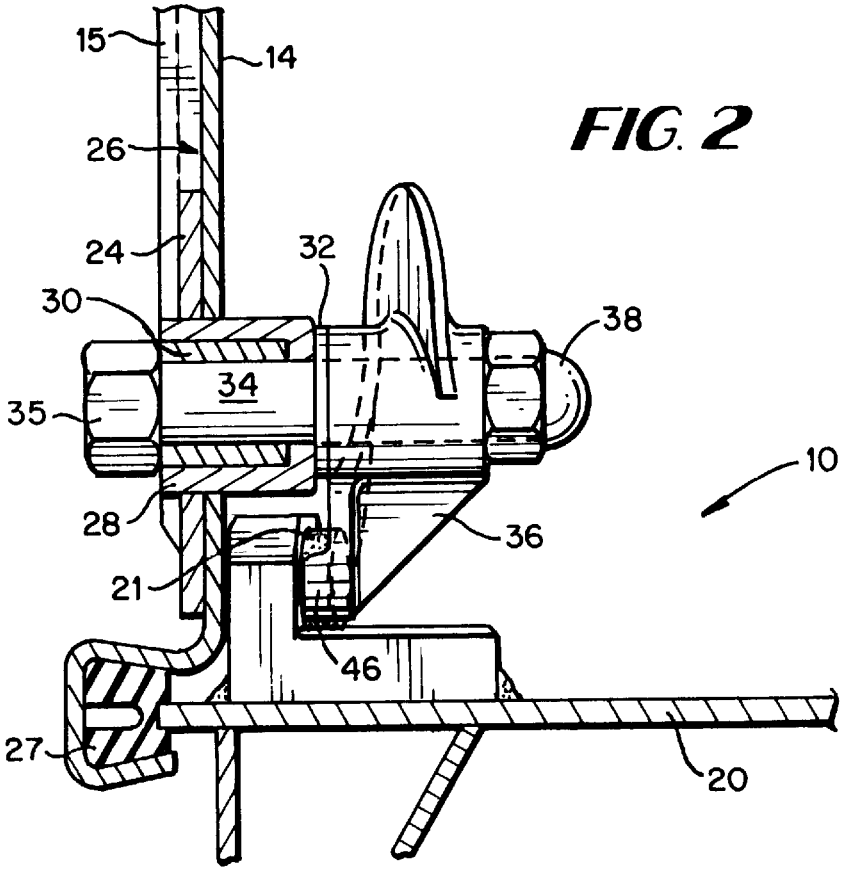
FIG. 2 is an enlarged fragmentary sectional view of the latch dog assembly of this invention taken along line 2—2 in FIG. 1.

In the embodiment of the invention as shown in FIGS. 1 through 12*b*, there is provided an improved latch dog assembly, indicated generally at 10 in FIG. 2, which is shown in FIG. 1 in assembly relation with a storage bin 12 having a discharge door 14 attached by a hinge assembly 16 to a bin wall 18. The bin 12 also has an adjacent wall 20 as shown in FIG. 2 on which a latch dog housing 22 is mounted in a fixed position such as by welding, for example. A suitable gasket 27 is provided at the junction of the door 14 and the adjacent wall 20.

The door 14 has a pair of raised ribs 15 which can be formed into the door 14 and a reinforcing plate 24 secured to the outer surface 26 of the door 14. Inwardly of the reinforcing plate, there are located a bolt housing 28, a bushing 30 and washer member 32.

A latch bolt 34 extends axially through the bolt housing 28 and through the washer member 32 and has a helical latch cam 36, the cam shape features of which are conventional, mounted on its inner end and maintained thereon in a fixed position by a nut 38. An enlarged head 35 is provided on the outer end of the latch bolt 34.

In the embodiments of the invention as shown in FIGS. 3 through 10, the latch dog housing has a base portion 42 and an end wall portion 44. The base portion has a top 25 and bottom 29 surface and the end wall portion includes an inner 43 and outer 45 wall as well as a top edge 47. The base portion 42 is substantially horizontal and the base portion top 25 and bottom 29 surfaces are substantially parallel. The end wall portion 44 is substantially vertical so as to be substantially perpendicular to the base portion 42. The end wall portion 44 includes a sloped back portion 46 which provides clearance for the helical latch cam 36 to close the bin door 14 and start rotation to clamp.

The latch dog housing 22 also includes a cylindrical opening 31 within the inner wall 43 of the end wall portion for receiving a wear block insert 21. The opening 31 is formed so as to allow the inserted wear block to extend substantially perpendicularly from the inner wall 43. The wear block insert 21 may be made of UHMW polyethylene plastic or similar material, for example, and as shown in FIGS. 2 through 10, the wear block 21 is cylindrical so as to allow for simple insertion into and removal from opening 31. The cylindrical shape of the wear block combined also allows the wear block to be rotated within the opening 31 as well as reversed so as to allow for even wear on the wear block over the course of use. The rotation or reversal of the wear block will not affect the operation of the latch dog assembly or the amount of wear block surface area encountered by the cam 36 during operation. Thus, the latch dog assembly of the present invention effectively prolongs the life of the wear block insert 21 by allowing rotation and reversal of the wear block insert 21 within inner wall opening 31 so as to evenly distribute the wear to the wear block insert. Additionally, the cylindrical shape of opening 31 allows the housing to be easily flushed or cleaned so that there are no hard to reach areas which could allow residual liquid to stand or accumulate.

As shown in FIGS. 4 and 8, the inner wall 43 of the end wall portion 44 extends at an angle A of about 8 to 15 degrees relative to the transverse axis of the housing 22. This allows the front face 23 of the wear block to be appropriately angled to allow the pressure of the latch cam 36 to help retain the wear block 21 in the latch dog housing 22 during normal operation. Thus the front face 23 of the wear block 21 will match up with the angular face or pitch of the cam 36. Also, this construction assists in providing close engagement of the cam 36 and its lug 46 with the housing 22 in the closed position of the door 14, as shown in FIG. 2. The lug 46 on cam 36 serves as a stop when engaged with the wear block 21.

As shown in FIGS. 3 through 12*b*, a projection or protrusion 50 extends upwardly from the base portion top surface 25 to further assist in maintaining the wear block 21 in place within the inner wall opening 31. The projection 50 is of sufficient height to allow the wear block 21 to be easily removed as described hereinafter. In one embodiment of the invention, the projection has a height of approximately 0.03 inches. Additionally, the projection 50 can vary in shape. For example, as shown in FIGS. 3 through 6, the projection 50 can be round-shaped, or as shown in FIGS. 7 through 11*b*, the projection can be oval or bullet-shaped, or as shown in FIGS. 12*a* and 12*b*, the projection can be rectangular in shape. In one embodiment of the invention, the projection 50 is positioned on the top surface 25 of the base portion 42 at a position proximal to the radially outer edge 54 of the wear insert. This ensures sufficient contact between the projection and the wear insert to allow the projection 50 to help sufficiently retain the wear block insert within the inner wall opening 31.

In the embodiment as shown in FIGS. 3 through 6, the wear block 21 can be removed by applying a screw driver or similar tool through an opening 40 in the outer wall 45 of the end wall portion 44 of the latch dog housing 22. This back opening 40 may be cylindrical, for example, and extends through the end wall portion to allow fluid communication with inner wall opening 31. Such construction provides for easy removal or replacement of the wear block 21 without the use of special tools and also provides for thorough cleaning from the inside or outside of the bin 12. As shown in FIG. 6, the opening 40 should be of sufficient size to allow a screw driver blade or other similar implement to be inserted against the back side of the wear block 21 when the wear block is appropriately positioned within opening 31. In the embodiment as shown in FIGS. 7 through 10, no outer wall opening is provided and, in this embodiment, the wear insert may be pulled from the housing 22 by clamping with a pair of pliers or by applying a screw driver or similar tool under the wear block to pry it over projection 50.

The latch dog housing 22 is preferably constructed of aluminum, stainless steel or other suitable metal and the wear block 21 is preferably of a low friction material such as UHMW polyethylene plastic, for example, for sanitation purposes and to reduce friction between moving parts during operation. Also, the edges 52 of the latch dog housing are beveled, as shown in FIG. 3, to remove the sharp edges of the latch dog housing 22.

In the operation of the latch dog assembly 10, upon closing the door 14, the latch cam 36 clears the latch dog housing 22 as the lower edge of the door 14 engages the bin wall 18. The bolt head 35 is tightened so as to rotate the bolt 34 and apply the latch cam 36 to the wear plate 21, which thus avoids any undesired metal to metal contact. As the force applied to the cam 36 increases, the latch bolt 34 is compressed inwardly so as to obtain the desired seal for use in FDA, USDA and PHARM environments in which leakage of the bin contents must be prevented.

What is claimed and desired to be secured by Letters Patent is:

1. A latch dog assembly for a bin used in storing and transporting bulk material, said bin having an opening for discharge of said material and a hinged door for exposing and closing said opening, said hinged door having cam means, said latch dog assembly comprising a latch dog housing for mounting in a fixed position in said bin adjacent said opening, said latch dog housing having a base portion and an end wall portion, said end wall portion having inner and outer walls and having a substantially cylindrical opening within said inner wall, said latch dog assembly further including a substantially cylindrical wear block positioned within said inner wall opening for contact with said cam means, wherein said housing has a transverse axis and wherein said end wall portion inner wall extends at an angle of approximately 8 to 15 degrees relative to the transverse axis of the housing.

2. The latch dog assembly of claim 1 wherein said base portion has substantially parallel top and bottom surfaces.

3. The latch dog assembly of claim 2 wherein said base portion is substantially perpendicular to said end wall.

4. The latch dog assembly of claim 3 wherein said wear block is constructed of UHMW polyethylene plastic.

5. The latch dog assembly of claim 2 wherein said base portion top surface further includes a projection extending outwardly therefrom so as to retain said wear block within said inner wall opening.

6. The latch dog assembly of claim 5 wherein said projection is approximately 0.03 inches in height.

7. The latch dog assembly of claim 5 wherein said projection is substantially rectangular in shape.

8. The latch dog assembly of claim 5 wherein said projection is substantially circular in shape.

9. The latch dog assembly of claim 5 wherein said is substantially oval or bullet-shaped.

10. The latch dog assembly of claim 5 wherein said wear block has a radially outer edge and wherein said projection extends outwardly from said base portion top surface at a position proximal to said wear block's radially outer edge.

11. The latch dog assembly of claim 1 wherein said latch dog housing is formed of aluminum.

12. A latch dog assembly for a bin used in storing and transporting bulk material, said bin having an opening for discharge of said material and a hinged door for exposing and closing said opening, said hinged door having cam means, said latch dog assembly comprising a latch dog housing for mounting in a fixed position in said bin adjacent said opening, said latch dog housing having a base portion and an end wall portion, said end wall portion having inner and outer walls and having a substantially cylindrical opening within said inner wall, said latch dog assembly further including a substantially cylindrical wear block positioned within said inner wall opening for contact with said cam means, wherein said base portion has substantially parallel top and bottom surfaces, and wherein said base portion top surface further includes a projection extending outwardly therefrom so as to retain said wear block within said inner wall opening.

* * * * *